US005839459A

United States Patent [19]

Bisby

[11] Patent Number: 5,839,459

[45] Date of Patent: Nov. 24, 1998

[54] PAINT ROLLER CLEANING APPARATUS

[76] Inventor: William G. Bisby, 100 Parkhill Terrace Dr. #24, Fenton, Mo. 63026

[21] Appl. No.: 949,260

[22] Filed: Oct. 13, 1997

[51] Int. Cl.[6] ..... B08B 3/02

[52] U.S. Cl. ..... 134/138; 134/147; 134/153; 134/177; 134/900

[58] Field of Search ..... 134/138, 147, 134/153, 900, 201, 172, 177, 180, 183, 198

[56] References Cited

U.S. PATENT DOCUMENTS

| | | | |
|---|---|---|---|
| 2,831,488 | 4/1958 | Anderson | 134/900 |
| 3,075,534 | 1/1963 | Habostad | 134/900 |
| 3,688,785 | 9/1972 | Stevens et al. | 134/900 |
| 3,897,797 | 8/1975 | Wright et al. | 134/900 |
| 4,130,124 | 12/1978 | Sherwin | 134/900 |
| 4,402,333 | 9/1983 | Frizzell et al. | 134/900 |
| 4,641,673 | 2/1987 | Conley et al. | 134/900 |
| 4,672,987 | 6/1987 | Brandt | 134/900 |
| 4,700,728 | 10/1987 | Patterson | 134/900 |
| 4,809,722 | 3/1989 | Pennise | 134/900 |
| 5,413,133 | 5/1995 | Russell | 134/900 |

*Primary Examiner*—Frankie L. Stinson
*Attorney, Agent, or Firm*—Zarley, McKee, Thomte Voorhees & Sease

[57] ABSTRACT

A paint roller cleaning apparatus includes a hollow pipe with notches formed at the lower end to permit fluid to escape from the interior of the pipe. A tubular spray arm is rotatably mounted within the pipe and has a plurality of vertically aligned and spaced apart apertures to spray cleaning fluid along the length of a paint roller positioned within the pipe. An elbow at the top of the paint arm projects out from the pipe and is connected by a flexible hose to a source of water or other cleaning fluid. A clip on the exterior of the pipe will grip the support rod of a paint roller, and a slot in the upper edge of the pipe will receive the support rod so that the paint roller will be journaled in a vertical orientation with the roller longitudinal axis parallel to the longitudinal axis of the spray arm.

7 Claims, 4 Drawing Sheets

PAINT ROLLER CLEANING APPARATUS

TECHNICAL FIELD

The present invention relates generally to apparatus for cleaning paint rollers, and more particularly to an improved self-contained cleaning apparatus which continuously cleans conventional paint rollers.

BACKGROUND OF THE INVENTION

Paint rollers provide the consumer with a simple and effective way of quickly painting a surface area. However, washing the paint out of a conventional paint roller in order to reuse the roller for the next job, is extremely time consuming, and can create a large mess in the process.

SUMMARY OF THE INVENTION

It is therefore a general object of the present invention to provide an improved paint roller cleaning apparatus.

Another object is to provide a paint roller cleaning apparatus which is powered by water pressure.

Still a further object of the present invention is to provide a paint roller cleaning apparatus which automatically cleans a paint roller without requiring the consumer to touch or manipulate the roller.

A further object is to provide a paint roller cleaning apparatus which is economical to manufacture and easy to use.

These and other objects of the present invention will be apparent to those skilled in the art.

The paint roller cleaning apparatus of the present invention includes a hollow pipe with notches formed at the lower end to permit fluid to escape from the interior of the pipe. A tubular spray arm is rotatably mounted within the pipe and has a plurality of vertically aligned and spaced apart apertures to spray cleaning fluid along the length of a paint roller positioned within the pipe. An elbow at the top of the paint arm projects out from the pipe and is connected by a flexible hose to a source of water or other cleaning fluid. A clip on the exterior of the pipe will grip the support rod of a paint roller, and a slot in the upper edge of the pipe will receive the support rod so that the paint roller will be journaled in a vertical orientation with the roller longitudinal axis parallel to the longitudinal axis of the spray arm.

DESCRIPTION OF THE PREFERRED EMBODIMENT

Figure 1:
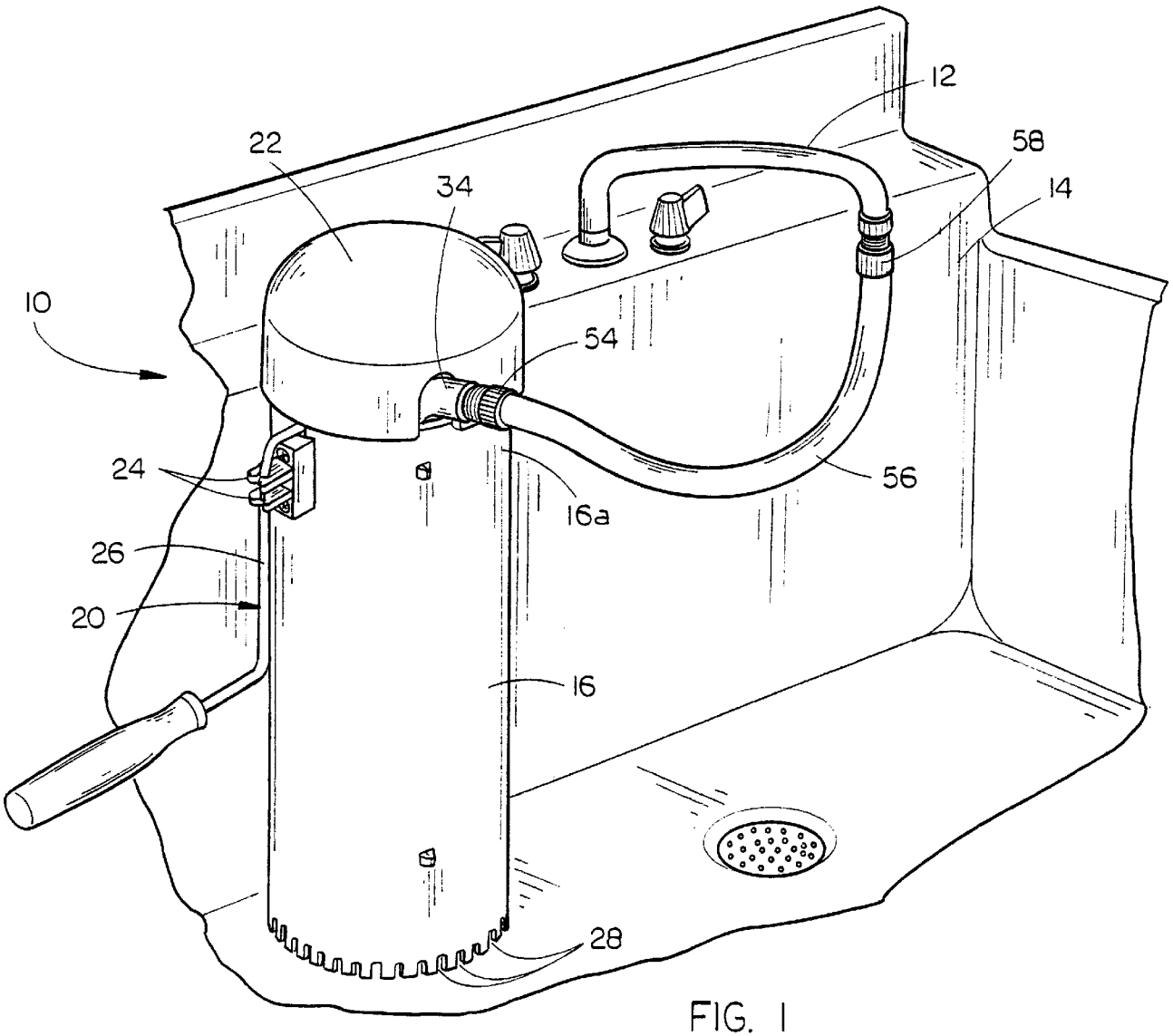
FIG. 1 is a pictorial view of the paint cleaning apparatus of the present invention connected to the spigot of a conventional sink.

Referring now to the drawings, in which similar or corresponding parts are identified with the same reference numeral and more particularly to FIG. 1, the paint roller cleaning apparatus of the present invention is designated generally at 10 and is shown connected to a conventional spigot 12 in a sink 14.

Cleaning apparatus 10 includes a vertically oriented pipe 16 preferably of a diameter of four inches or more, thereby providing plenty of room within the pipe to receive the roller 18 (shown in FIG. 3) of a conventional paint roller 20. The upper end 16*a* of pipe 16 has a removable lid 22, to permit insertion of roller 18 within pipe 16. A pair of clips 24 are mounted on the side wall of pipe 16 to grip the paint roller support rod 26, and maintain the roller in a vertical orientation within the pipe 16.

Figure 2:
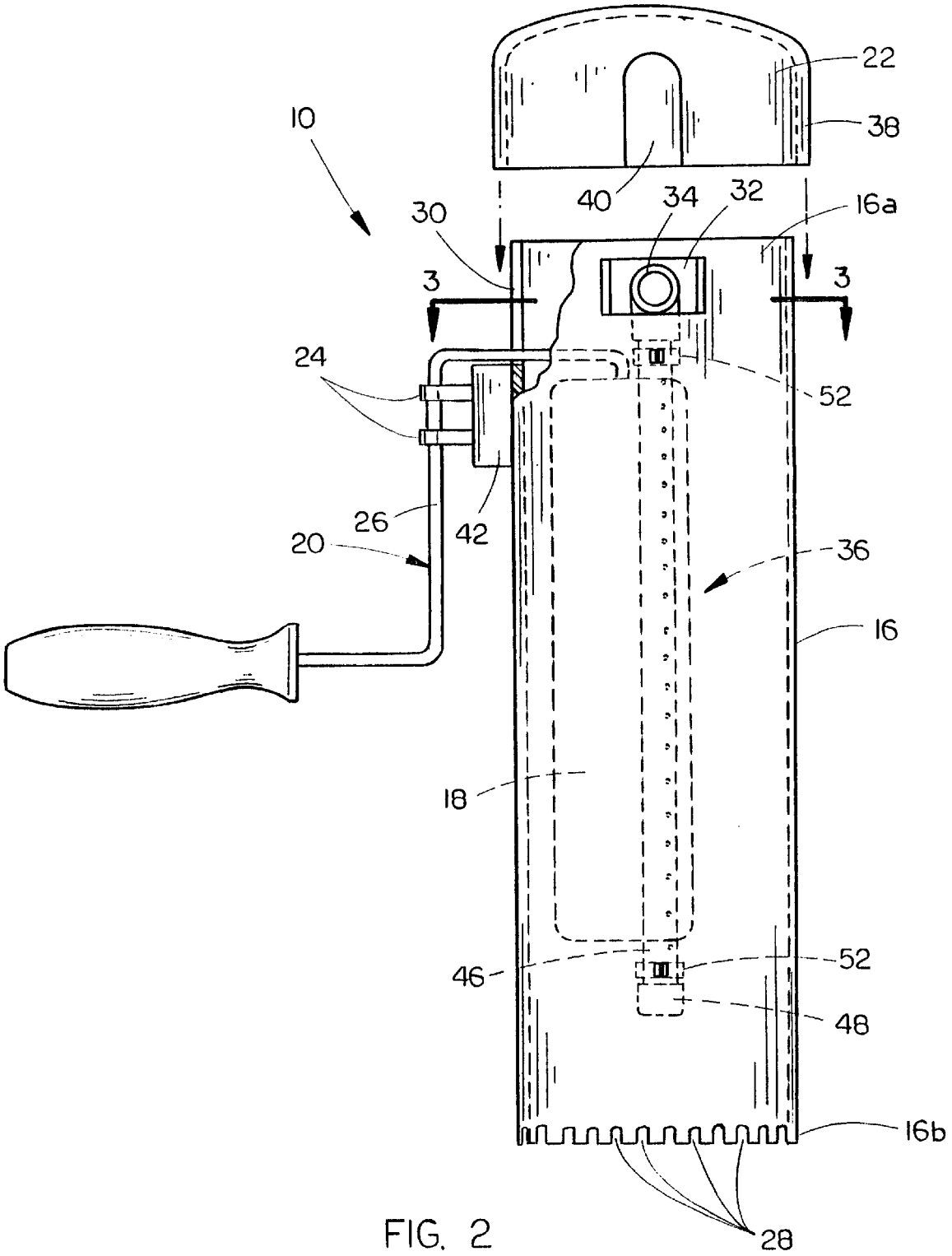
FIG. 2 is an elevational view of the invention with the top removed, and portions in sectional view, for clarity.
Figure 3:
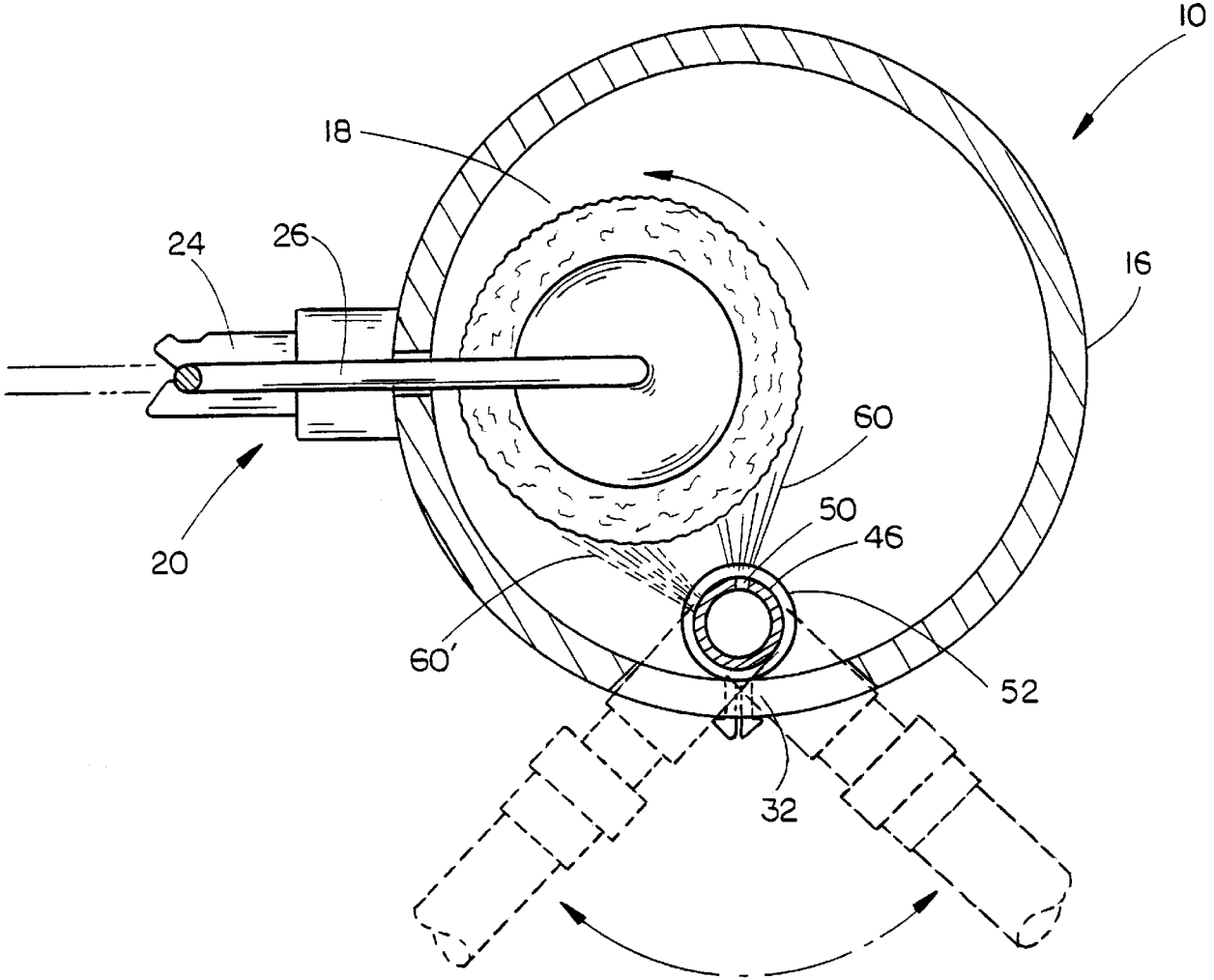
FIG. 3 is a sectional view taken at lines 3—3 in FIG. 2.
Figure 4:
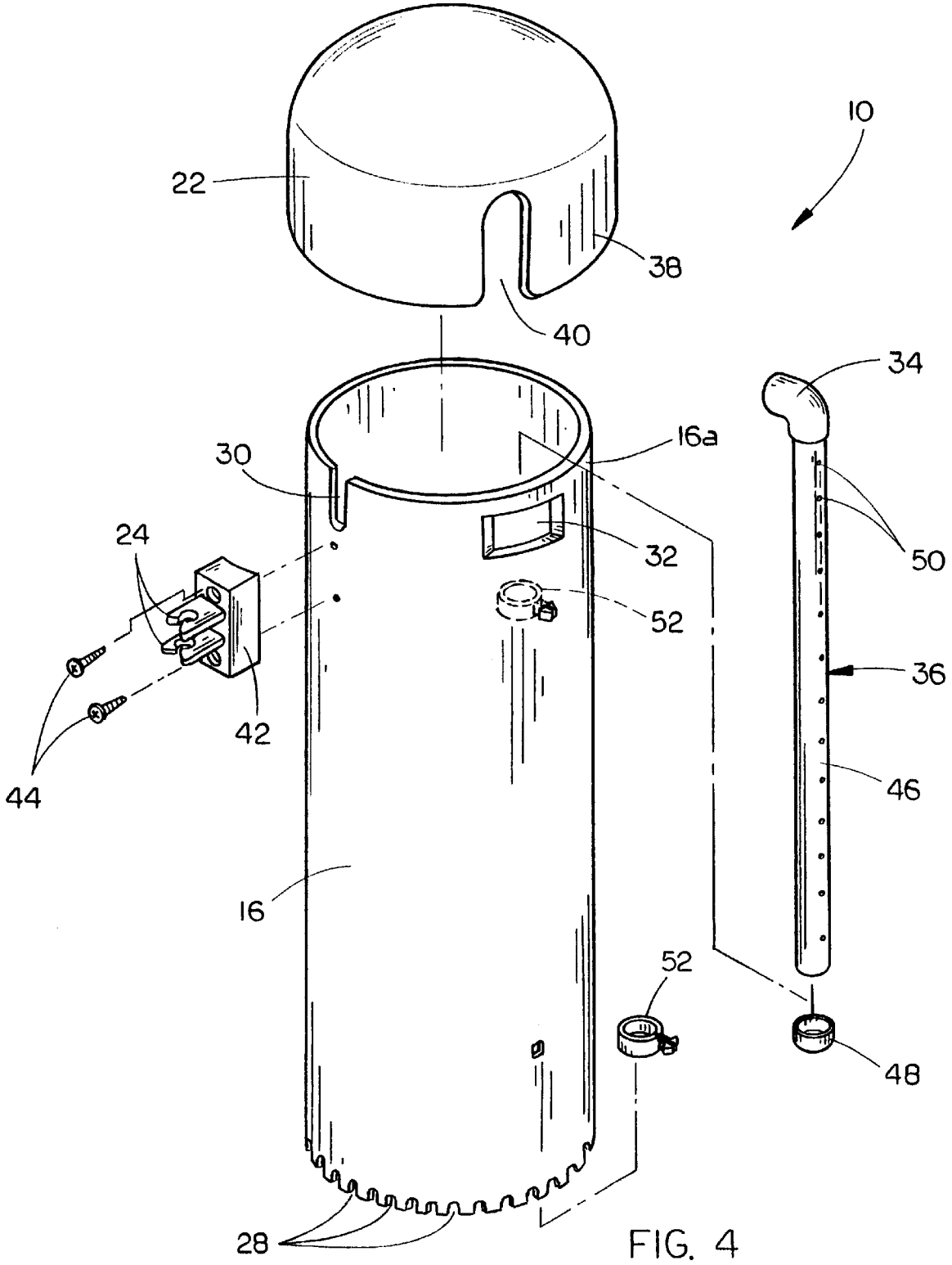
FIG. 4 is an exploded perspective view of the invention.

Referring now to FIGS. 2–4, it can be seen that pipe 16 has a plurality of notches 28 formed along the lower edge 16*b* thereof. As shown in FIG. 1, notches 28 will permit water and paint to exit from pipe 16 as the roller is being washed.

The upper end 16*a* of pipe 16 has a slot 30 extending downwardly from the upper edge, and located directly above clip 24. Slot 30 has a width slightly larger than the diameter of the paint roller support rod 26, to receive the rod therein. An elongated aperture 32 is formed in the side wall of pipe 16 slightly below the upper edge thereof, through which the elbow 34 of spray arm 36 will extend, as described in more detail hereinbelow.

Lid 22 includes a cylindrical side wall 38 have an inner diameter slightly larger than the outer diameter pipe 16, so that lid 22 fits snugly on the upper end of pipe 16, but is rotatable thereon. A slot 40 extends vertically upwardly from the lower edge of lid side wall 38 and has a width greater than the diameter of elbow 34, to permit the elbow 34 to project therethrough.

A block 42 is attached to pipe 16 with fasteners 44, and located directly below slot 30. Block 42 has clip 24 mounted on the surface thereof, to permit selective attachment of the paint roller support rod on clip 24. Additional clips may be added to block 42 if additional support is desired for the paint roller support rod.

Spray arm 36 includes an elongated tube 46 having upper and lower ends, with a cap 48 mounted on the lower end and elbow 34 mounted on the upper end. A plurality of spray apertures 50 are uniformly spaced apart and vertically aligned along one side of tube 46, to spray water or other fluid. Elbow 34 is preferably 90° elbow, and has one end mounted to the upper end of tube 46, and the other end projecting outwardly through aperture 32 in pipe 16. Tube 46 of spray arm 36 is rotatably journaled through a pair of coaxial collars 52, to permit rotation of tube 46 along its vertical axis. Collars 52 are split, and have a pair of beveled ends, for a snap fit through holes in the side wall of the pipe.

In operation, the cleaning apparatus 10 is connected to a source of water, as shown in FIG. 1. This may be accomplished in a number of ways. Preferably, elbow 34 includes an adaptor 54 permitting connection to a hose 56 which in turn has a second adaptor 58 at the opposite end permitting connection to spigot 12. Lid 22 is removed from pipe 16, and the roller 18 of paint roller 20 is inserted in a vertical orientation within pipe 16, as shown in FIGS. 2 and 3. Paint roller support rod 26 rests in the bottom of slot 30 and is snapped into clip 24 to maintain roller 18 in a freely rotatable vertical orientation.

Lid 22 is then replaced on pipe 16 with slot 40 journaled over elbow 34, and the lid side wall 38 covering the remaining open portion of slot 30 above paint roller support rod 26. Spray tube 46 may be positioned in one of two positions as shown in FIG. 3, such that spray apertures 50 are directed generally tangent to one side edge of roller 18 or the other. The orientation of spray tube 46 is important, because the water spray, designated generally at 60 in FIG. 3, will cause roller 18 to rotate, as the paint is being washed from the nap of the roller. The rotation of roller 18 may be reversed by moving the spray tube 46 from the solid line position to the broken line position of FIG. 3. Spray 60' is shown in broken lines to indicate the second position of spray tube 46, and would cause rotation of roller 18 in the opposite direction.

After a few minutes (ranging from about five minutes for a one-quarter inch nap roller to about thirty minutes for a three-quarter inch nap roller) clean water will be exiting from notches 28, indicating that the paint roller is clean. The water supply to the cleaning apparatus is turned off, lid 22 removed, and the paint roller may then be removed from the cleaning apparatus 10.

Whereas the invention has been shown and described in connection with the preferred embodiment thereof, many modifications, substitutions and additions may be made which are within the intended broad scope of the appended claims.

I claim:

1. A paint roller cleaning apparatus, comprising:

a hollow tubular pipe having open upper and lower ends and an interior;

a slot extending downwardly from an upper edge of the pipe, for receiving a paint roller support rod therein, the slot having a lower end;

an elongated aperture in the pipe proximal to and spaced below the upper edge and extending generally horizontally, for receiving a tubular elbow therethrough;

a spray arm connected in a generally vertical orientation within the interior of the pipe, said spray arm including a tube with a plurality of vertically aligned and vertically spaced apart spray apertures therein for spraying fluid generally horizontally from the spray arm;

the spray arm including an elbow at an upper end thereof with one end fluidly connected to an upper end of the spray arm tube, and a second end projecting through the pipe aperture and extending outwardly from the pipe a lid removably and rotatably connected to the upper end of the pipe, for selectively enclosing the upper end of the pipe and being rotatable thereon;

said lid including a continuous depending side wall extending downwardly to substantially cover the slot;

said lid including a slot extending upwardly from a lower edge of the side wall, for receiving the projecting portion of the elbow therein and for pivoting the elbow within the aperture about a longitudinal axis of the spray arm when the lid is rotated, so as to rotate the spray arm within the pipe; and a plurality of legs mounted on the lower end of the pipe, supporting the pipe above a support surface to permit fluid flow out of the lower end of the pipe.

2. The apparatus of claim 1, further comprising at least one clip mounted on an exterior surface of the pipe and positioned for removably retaining a paint roller support rod therein, to hold a paint roller in a vertical orientation within the pipe.

3. The apparatus of claim 2, further comprising means connected to the pipe for rotatably supporting the spray arm tube and for permitting rotatable movement of the spray arm about the vertical longitudinal axis of the spray arm tube.

4. The apparatus of claim 3, wherein said means for rotatably supporting the spray arm tube includes at least one collar mounted on the pipe with the spray arm tube rotatably journaled therethrough.

5. The apparatus of claim 1, further comprising means connected to the pipe for rotatably supporting the spray arm tube and for permitting rotatable movement of the spray arm about a vertical longitudinal axis of the spray arm tube.

6. The apparatus of claim 5, wherein said means for rotatably supporting the spray arm tube includes at least one collar mounted on the pipe with the spray arm tube rotatably journaled therethrough.

7. The apparatus of claim 6, wherein said opening of the lower end of the pipe includes a plurality of spaced apart notches extending upwardly along a lower edge of the pipe.

* * * * *